US006889623B2

(12) United States Patent
Ferrari

(10) Patent No.: US 6,889,623 B2
(45) Date of Patent: May 10, 2005

(54) SLIDING KEEL SAILBOAT WITH A HULL WITH REDUCED ROLLING

(76) Inventor: Agostino Ferrari, Via XX Settembre 12, 25080 Nuvolento (Brescia) (IT)

( * ) Notice: Subject to any disclaimer, the term of this patent is extended or adjusted under 35 U.S.C. 154(b) by 0 days.

(21) Appl. No.: 10/467,456

(22) PCT Filed: Jul. 30, 2001

(86) PCT No.: PCT/IB01/01365

§ 371 (c)(1),
(2), (4) Date: Aug. 7, 2003

(87) PCT Pub. No.: WO02/062656

PCT Pub. Date: Aug. 15, 2002

(65) Prior Publication Data

US 2004/0065243 A1 Apr. 8, 2004

(30) Foreign Application Priority Data

Feb. 7, 2001 (IT) ..... MI2001A0237

(51) Int. Cl.[7] ..... B63B 41/00
(52) U.S. Cl. ..... 114/143; 114/98
(58) Field of Search ..... 114/90, 91, 98, 114/143; 440/6

(56) References Cited

U.S. PATENT DOCUMENTS

| | | | | | |
|---|---|---|---|---|---|
| 3,985,106 | A | | 10/1976 | Ross | |
| 4,638,755 | A | * | 1/1987 | Butka | 114/91 |
| 4,867,089 | A | | 9/1989 | Haigis | |
| 6,058,867 | A | * | 5/2000 | Ettel | 114/91 |

FOREIGN PATENT DOCUMENTS

| | | |
|---|---|---|
| FR | 2688189 | 9/1993 |
| WO | WO 87/00812 | 2/1987 |
| WO | WO 98/05552 | 2/1998 |

* cited by examiner

*Primary Examiner*—Jesus D. Sotelo
(74) *Attorney, Agent, or Firm*—Young & Thompson

(57) ABSTRACT

A sliding keel sailboat of the type comprises a sailing hull, a mast and a sailing arrangement whereon aero-dynamic forces, apt to be transferred to the hull through the mast, push, the mast being integral with a pivoting structure which can swing around a pivoting axis, parallel to a longitudinal central axis of the sailboat, in a respective seat in the sailing hull, the pivoting structure being arranged so that the crew can stand on it so as to balance the forces acting on the mast.

13 Claims, 3 Drawing Sheets

SLIDING KEEL SAILBOAT WITH A HULL WITH REDUCED ROLLING

BACKGROUND OF THE INVENTION

The present invention refers to a sliding keel sailboat with a hull with reduced rolling.

As it is known, in the field of sailboats, different problems deriving from the sailing conditions and driving techniques exist. The present Applicant addressed efforts to solve at least two problems in particular, the first connected with the efficiency of the hull immersed in the water and the second connected with the comfort of the passengers during sailing.

In the standard sailboats, in which fittings and equipment are tightly bound to the hull, the action of the wind onto the sail surface gives rise to some forces which are transferred to the hull by a mast. Since the forces acting on the mast have a considerable lever arm in respect of the centre of gravity of the hull, it results a couple which tends to determine a certain roll angle, which angle is determined by the different forces at stake, weight and position of the crew aboard included.

The resulting attitude or roll angle in balance conditions, causes a twofold problem: from one hand, the so-called water lines of the hull are different from condition to condition, (continuously changing in compliance with the modification of the roll angle) and therefore they could not result appropriate in the specific state of sailing; from the other hand it results a heel attitude of the hull, to the point that the edges of the hull are partially immersed in the water or, even, the capsizing of the whole sailboat happens (which event, is not very appreciated by the inexperienced passengers which are aboard and also by the crew during the winter months).

But while the second problem has a minor importance—being connected with a general condition of "comfort"—the first one is of concern in all the sailboats where extra performances are required. In fact, if it is possible to design a hull provided to keep a constant attitude, it will also possible identify "water lines" extremely efficient without any sort of compromise, offering great advantages to the sailboat performance.

In the field, various attempts have been made to find an arrangement for the hull, equipment and rigging such to maintain the hull with a constant attitude, notwithstanding wind conditions.

Solutions which fores e to clear the mast from the hull by means of hinges or suitable kinematic chains, are among the most tested, but no one has had a convincing and satisfying practical application so far.

An example of said design, even if applied to a keel sailboat, consequently of big dimensions, is EP-A-375.637. Said document teaches to assembly a mast to a hull through a pin which allows the lateral swing of the mast. The mast crosses the hull in full and it is below linked to the mass of the keel, which keel also oscillates together with the mast. It is comprehensible how much such a solution is complex, both from the mechanical as well as the hydrodynamic point of view. Further, said solution has been only conceived for sailboats with big dimensions. Furthermore it is to be noted that having a deck plane completely stable, the acrobatic entertainment, often appreciated by the crew aboard, is absent.

SUMMARY OF THE INVENTION

The object of the present invention is therefore to provide a sliding keel sailboat in which the hull immersed in the water can maintain a substantially constant attitude for any wind condition, without the disadvantages of the above mentioned prior art occur, while keeping unchanged the entertainment conditions for the crew aboard.

Said object is achieved by a sailboat as described in the first claim.

Other inventive aspects of the present invention are described in the dependent claims.

BRIEF DESCRIPTION OF THE DRAWINGS

Further characteristics and advantages of the sailboat according to the invention, however, will result more evident from the following detailed description of a preferred embodiment, given as an example as illustrated in the annexed drawings, wherein.

DETAILED DESCRIPTION OF THE EMBODIMENTS

A sailboat, in a way "per se" known, consists of a sailing hull 1 (having volume and dimensions which depend on the specific design), a mast 2, a sailing surface (not shown) as w ll as various quipment, for example trapezes 3 or safety belts (not shown).

A sliding keel D and one or more rudders T1 and T2 are provided at the bottom of the hull.

Specific areas whereon the crew can simply stand or which are apt for carrying on manoeuvres for driving the boat, are provided on the deck surface 1*a*.

Figure 3:
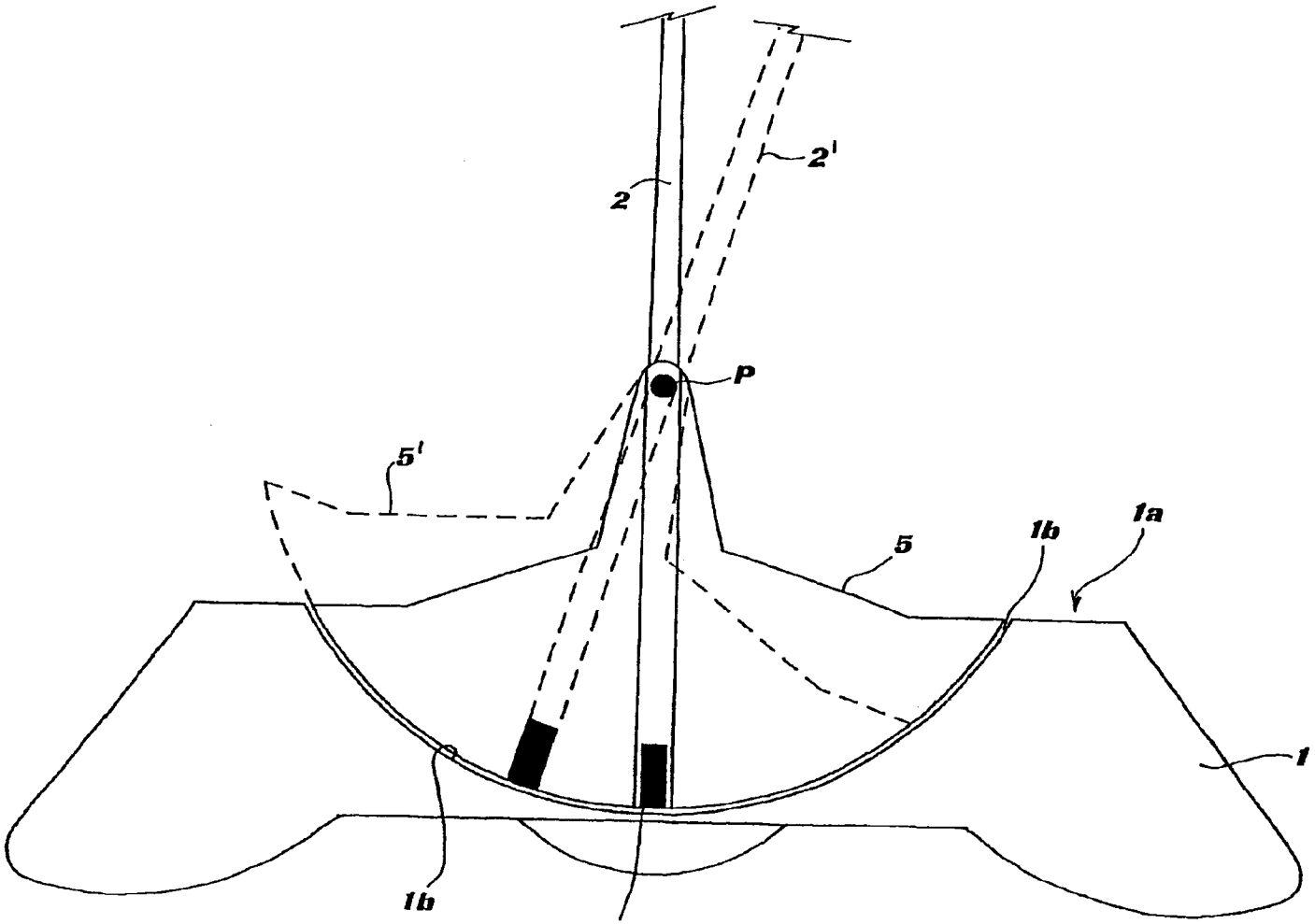
FIG. 3 is a partial schematic view of another embodiment which shows in detail the operation of the pivoting system.

According to the invention, the mast 2 is mounted integral with a pivoting structure 5, which structure in turn is pivoting around a longitudinal central axis of the sailboat, which is shown as projection in the point P (FIG. 3).

The pivoting structure 5 is housed in a corresponding seat 1*b* inside the hull. A guide and support system can be provided between the seat 1*b* and the structure 5, as for example, a couple of appropriate sliding rails, which confer enhanced stiffness to the system, cooperating with the supporting brackets of the pivoting axis (P).

In this way, the pivoting structure 5 together with the mast 2, are able to swing, about a roll axis, with respect to the hull 1.

As all the drawings show, the pivoting structure preferably has a transversal section substantially with semicircular shape. Advantageously, the bottom surface is cylindrical and closed: this avoids, therefore, that objects or some body parts of the crew (as for example a foot) can fall between the pivoting structure 5 and the seat 1*b* in the hull from the windward side, with imaginable consequences.

The longitudinal dimension of the structure 5 can be chosen on the base of design parameters which are not relevant to the present description.

To understand the operation, it is necessary to consider that the application of a pressure onto the sail surface coming from the left as shown in FIG. 3, causes a rotation of the pivoting structure 5 and of the mast 2, which take the new position as indicated with a broken line and with the numerical references 5' and 2', respectively. a balancing system, such as for example a mass M ( concentrated to the bottom end of the mast or distributed within the pivoting structure 5) or an equalizing device (as a set of springs) which operates between the structure 5 and the hull 1, is provided so as to avoid that the system results unsteady (the centre of gravity of the sail arrangement and of the mast, lying above the point P, naturally tends to locate below point P).

Figure 1:
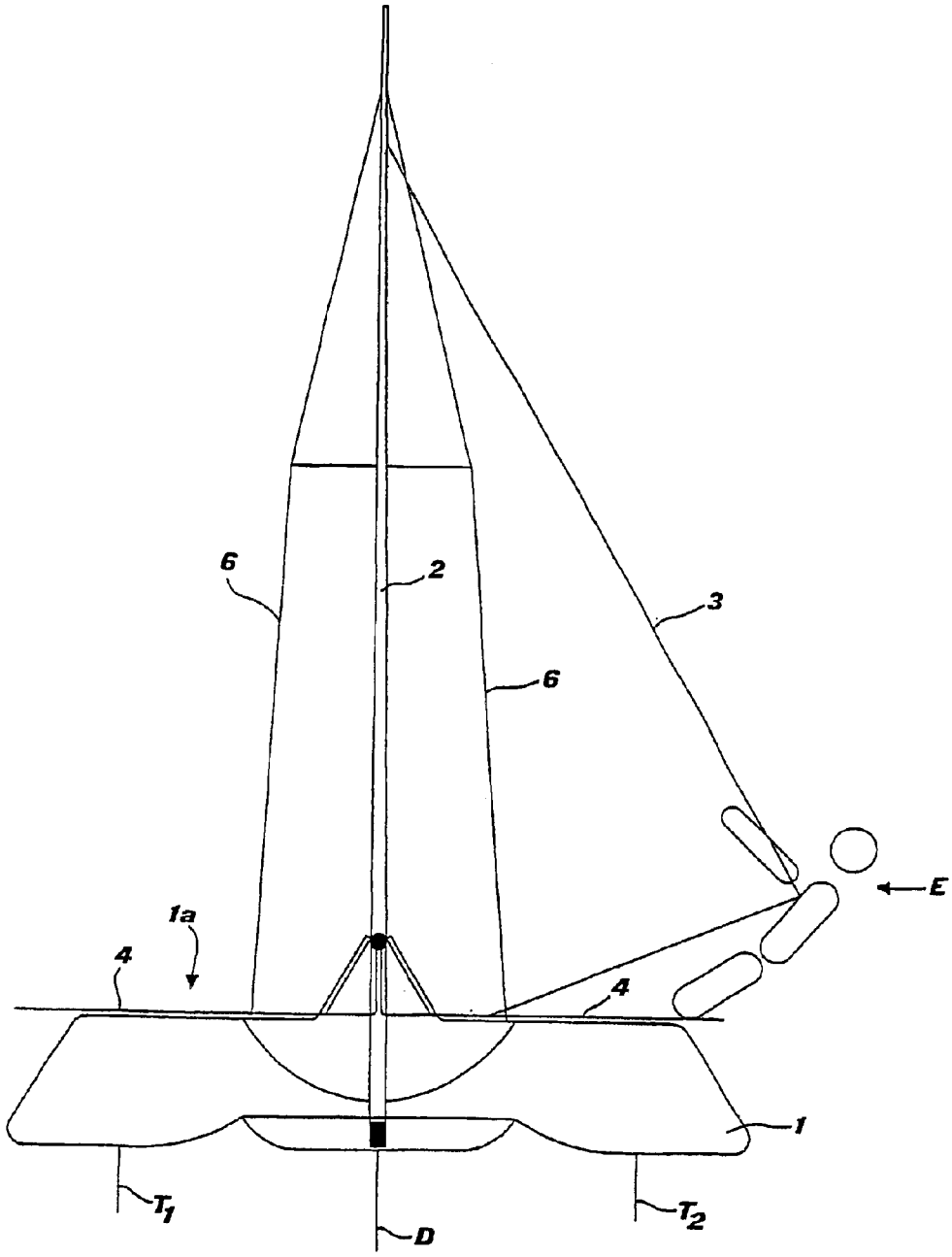
FIG. 1 is an elevation view, of the stern side of the sailboat according to the invention, the mast standing vertical.
Figure 2:
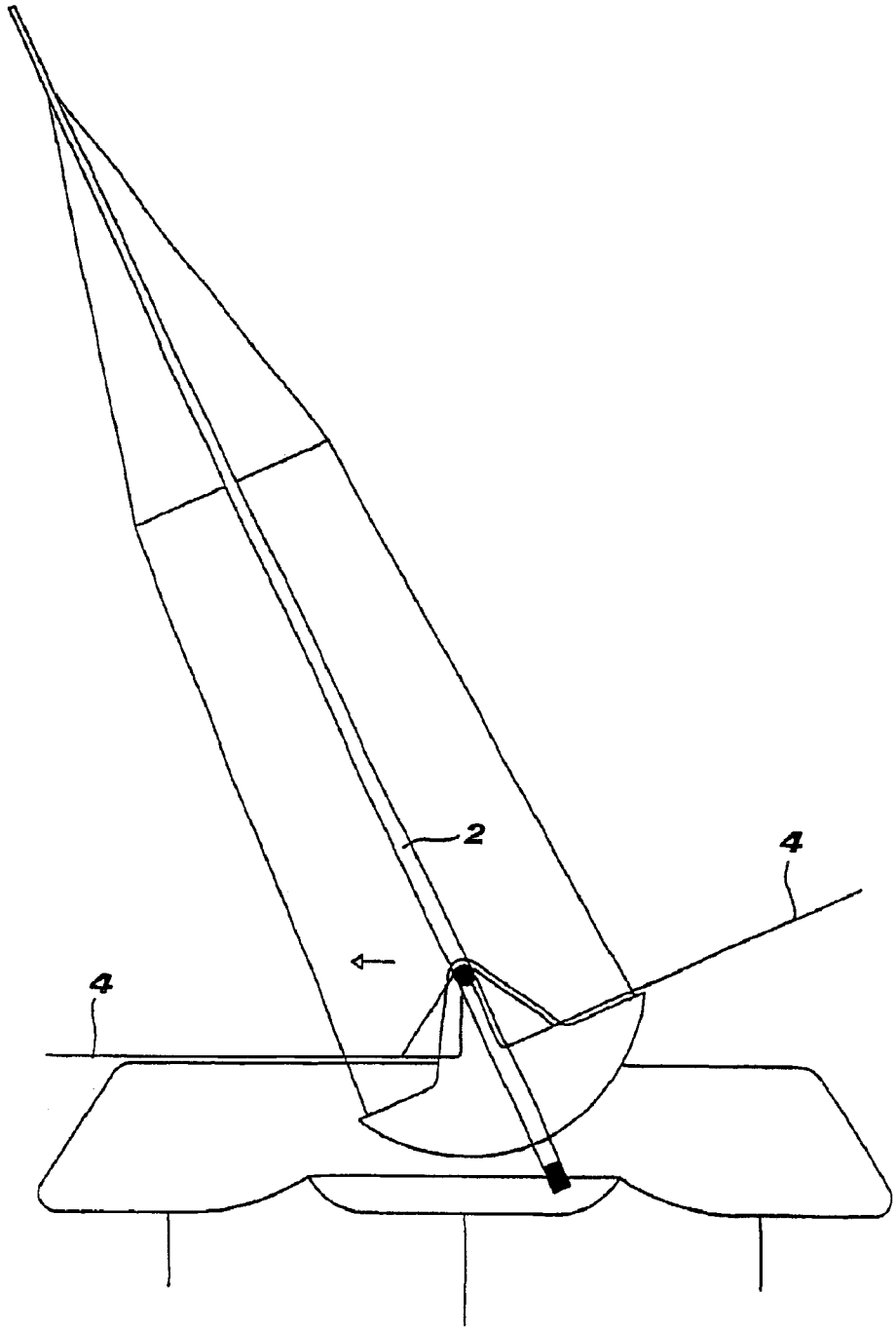
FIG. 2 is a view similar to that of FIG. 1, the mast being inclined of a certain angle.

The mass M can have a lever arm, with regard to the axis P, bigger than the radius of the pivoting sector 5 (as FIGS. 1 and 2 show).

To define, instead, the single balance positions of the system, upon variation of the aerodynamic pressures on the sail arrangement—namely to balance the tendency of the mast to fall under the wind pressure, what would substantially cancel the pushing effect on the sailboat—it is envisaged that the operating crew E (for example the forward man), resting on the pivoting structure 5 can move windward its own centre of gravity such as to create a redressing momentum on the mast/pivoting structure assembly.

Since the pivoting structure 5 cannot have an excessive transversal dimension, considering the fact that it could derive a pronounced interference with the hull even for small heel angles of the mast, according to a preferred embodiment of the invention two extension plates 4, rotatably mounted in relation to the structure 5, preferably rotating also around the point P, are provided one for each side of the sailboat. The plates 4, in their lower position are in contact with the pivoting structure 5 (FIGS. 1 and 2).

This construction enables the crew to further displace their weight towards the outside, so that to exercise a stronger redressing momentum on the mast/pivoting structure assembly. Since the two plates are free each other and pivoting in respect of the structure 5, there isn't any constraint on their length (along the width of the hull), since they do not integrally interfere with said hull on the lee side, as FIG. 2 perfectly shows.

Moreover it is to be noticed that, since on the lee side the plate is aligned with the deck surface 1*a* and the hull 1 is not subject to heel (as, on the contrary, it occurs in the traditional sailboats), it is impossible that the same plate, even if very long, falls into the water. This, evidently, represents an additional advantage, in particular for the eventual passengers which rest above it. Then, the fact, that the windward plate is displaced integrally with the pivoting structure, maintains the entertainment in the trapeze man activity which, being outwardly displaced on the windward side, will be raised of a considerable height over the water surface in condition of strong wind.

Finally, retaining shrouds 6 of the mast, which link an upper portion of the mast with the pivoting structure 5, so as to create a wind bracing which makes the same mast less flexible, may be provided. Equally, a forestay and aftstay are provided, which stays, not being subject to significant extensions or shortenings upon variations of the roll angle of the mast, may be fixed to the longitudinal extremities of the sailing hull.

From the above stated, it is evident that the crew and the principal equipments of the sailboat exclusively make reference to the pivoting structure, avoiding that couples or overturning forces operate on the lower sailing hull.

In other words, only forces longitudinally directed are transferred to the sailing hull.

Therefore, the latter, in all wind conditions, stays immersed in the water substantially with the same attitude or, at least, with a minimum roll angle: the objects expressed above are hence perfectly achieved.

According to a preferred embodiment of the invention, the balancing system also comprises a shock absorber device apt to slacken sudden adjustments of the mast, with regard to the hull, which are caused by an inconstant wind force (for example as a gusts).

Finally, a further embodiment of the invention provides that the pivoting structure is constrained in rotation not, or not only, around a pin in the point P, but even through constraints and guide means (such as for example, sliding rails having a track lying as a circle arch) which are located in the seat 1*b*.

Anyway, it is understood that the invention is not limited to the particular above described configurations, which only represent some not restrictive examples of the scope of the invention, but different variations are also possible, all within the reach of a skilled person without departing from the scope of the same invention.

For example, the shape of the hull and of its water lines can be widely altered with regard to the above described, but still using the teaching of the invention.

And also, it is not absolutely necessary that the lower surface of the pivoting structure, for preventing a foot of the crew being trapped into the seat of the sailing hull, on the windward side, is completely closed, but the same surface could have lightening holes or a mesh barrier.

I claim:

1. Sliding keel sailboat of the type comprising a sailing hull, a mast and a sail arrangement, said mast being mounted integral with a pivoting structure by a pivoting axis, parallel to a longitudinal central axis of the sailboat, to the hull structure, wherein said pivoting structure, free to rotate relative to the sailing hull, is arranged so as to allow the crew to lean it to balance wind forces acting on the leeward tilting mast, wherein at least two extension plates are further provided, one for each sailboat edge, also said plates swinging, free of each other, about a longitudinal axis with respect to said pivoting structure, the lower position of said plates being determined, alternatively, by the contact with said pivoting structure or with the deck surface of the sailing hull.

2. Sliding keel sailboat as in claim 1, wherein said pivoting structure (5) or said mast (2) have a stabilization system.

3. Sliding keel sailboat as in claim 2, wherein said stabilization system comprise a mass (M) having the center of gravity placed under said pivoting axis.

4. Sliding keel sailboat as in claim 2, wherein said stabilization system comprise further a shock absorber device, operating between the sailing hull (1) and said pivoting structure (5).

5. Sliding keel sailboat as in claim 1, wherein said pivoting structure (5), has a section shape as a circular sector.

6. Sliding keel sailboat as in claim 5, wherein the lower peripheral surface of said pivoting structure (5) is a portion a cylindrical surface.

7. Sliding keel sailboat as in claim 5, wherein constraint and guide means are provided between said pivoting structure and the relative seat in the sailing hull.

8. Sliding keel sailboat as in claim 7, wherein said constraint and guide means are rails running over an arch of a circle.

9. Sliding keel sailboat as in claim 1, wherein an anti-intrusion protection device is provided between said pivoting structure and said seat in the sailing hull.

10. A sliding keel sailboat comprising:

a sailing hull;

a pivoting structure pivotal within a seat in said hull about a first axis parallel to a longitudinal central axis of the sailboat;

a mast integrally mounted with said pivoting structure and pivotal about said first axis; and at least two extension plates on either side of said mast, said plates being independently swingable about a longitudinal axis with respect to said pivoting structure so that a lower portion of said plates are alternatively in contact with said pivoting structure and with a deck surface of the sailing hull, said mast being rotatable from a first position substantially perpendicular to said hull to a second position at an acute angle to said hull with respect to a leeward side of said sailboat, said pivoting structure being structured and arranged so that when said mast is in said second position, at least one crew member applies pressure to said pivoting structure from a windward side to balance wind forces acting on the mast.

11. The sliding keel sailboat as in claim 10, further comprising a stabilization system connected to at least one of said pivoting structure and said mast.

12. The sliding keel sailboat as in claim 11, wherein said stabilization system further comprises a shock absorber device between the sailing hull and said pivoting structure.

13. The sliding keel sailboat as in claim 10, further comprising an anti-intrusion protection device between said pivoting structure and said seat in said sailing hull.

* * * * *